US006168019B1

(12) United States Patent
Olson

(10) Patent No.: US 6,168,019 B1
(45) Date of Patent: Jan. 2, 2001

(54) ARRANGED PLURALITY OF WASTE MATERIAL-CONTAINMENT DEVICES

(76) Inventor: Mary Lou Olson, 626 Armstrong Ave., St. Paul, MN (US) 55102

( * ) Notice: Under 35 U.S.C. 154(b), the term of this patent shall be extended for 0 days.

(21) Appl. No.: 08/953,699

(22) Filed: Oct. 17, 1997

(51) Int. Cl.[7] ..... B65D 85/62
(52) U.S. Cl. ..... 206/390; 206/278
(58) Field of Search ..... 206/278, 438, 206/390, 554; 53/410

(56) References Cited

U.S. PATENT DOCUMENTS

| | | | | |
|---|---|---|---|---|
| 3,587,845 | * | 6/1971 | Wing | 206/554 |
| 3,870,150 | | 3/1975 | Hummel | 206/438 |
| 3,979,050 | * | 9/1976 | Cilia | 206/390 |
| 4,034,853 | * | 7/1977 | Smith | 206/278 |
| 4,071,921 | * | 2/1978 | Jury | 206/278 |
| 4,347,931 | | 9/1982 | Ginger | 206/438 |
| 4,502,599 | * | 3/1985 | Perecman | 206/554 |
| 4,645,251 | | 2/1987 | Jacobs | 294/1.3 |
| 4,677,697 | | 7/1987 | Hayes | 2/159 |
| 4,768,818 | | 9/1988 | Kolic | 294/1.3 |
| 4,773,532 | | 9/1988 | Stephenson | 206/278 |
| 4,788,733 | | 12/1988 | Lerner | 15/104.94 |
| 4,959,881 | | 10/1990 | Murray | 15/227 |
| 4,964,188 | | 10/1990 | Olson | 15/227 |
| 5,025,503 | * | 6/1991 | O'Brien | 206/390 |
| 5,065,863 | | 11/1991 | Moyet-Ortiz | 206/210 |
| 5,704,670 | * | 1/1998 | Surplus | 383/4 |
| 5,732,716 | * | 3/1998 | Utecht | 128/898 |

FOREIGN PATENT DOCUMENTS

| | | | | |
|---|---|---|---|---|
| 662266 | * | 4/1965 | (BE) | 206/390 |
| 429572 | * | 10 1962 | (CH) | 206/390 |

* cited by examiner

*Primary Examiner*—David T. Fidei
(74) *Attorney, Agent, or Firm*—Anthony G. Eggink

(57) ABSTRACT

An assembly of a plurality of material-containment devices is provided in roll or stack form. The individual material-containment devices have a material for absorbing waste product and a flexible bag. The bag may be everted through its opening after use to contain the absorbent material and waste. The individual devices each also have a hand-receiving structure for receiving a user's hand during use. Connection structure is associated between each device to interconnect the plurality of devices in an array or stack form. Additionally, the bag openings are non-parallel to the connection structure to facilitate use of the devices. The individual devices may each also have a closure structure for closing and sealing the everted bag after use and prior to disposal.

20 Claims, 4 Drawing Sheets

ARRANGED PLURALITY OF WASTE MATERIAL-CONTAINMENT DEVICES

BACKGROUND OF THE INVENTION

1. Field of the Invention

This invention relates generally to a device for absorption and containment of waste material for subsequent disposal, and more specifically, to a plurality of said devices arranged in a spiral roll dispensing structure.

2. Description of the Prior Art

Many types of hand-held disposable devices for waste material clean-up and containment have been developed. A number of waste handling articles have been proposed in which a glove or mitt-like article is first placed upon a user's hand and used to pick up and/or absorb the waste, and then is "everted" (turned inside-out) to form a "container" or "receptacle" for enclosing the waste within for disposal. Some of these waste handling articles may be tied or otherwise sealed to provide a closed container for disposal of the waste. Such waste handling articles may be found, for example, in U.S. Pat. Nos. 4,186,445; 4,768,818; 3,596,798; 4,034,853; 4,788,733; 4,677,697; 4,964,188; and 5,301,806.

U.S. Pat. No. 4,964,188 to Olson discloses a hand-held clean up-device which includes a flexible plastic bag. A glove or hand recess for receiving a user's hand is disposed within the flexible bag prior to use. An absorbent pad is provided to absorb liquid or semi-liquid waste. The flexible bag is evertible after use to form a container to facilitate subsequent disposal of the waste material and absorbent pad. The clean-up device includes drawstrings or similar closures to seal the bag prior to disposal. U.S. Pat. No. 5,301,806, also to Olson, discloses a firer development of the Olson '188 patent. These disposal devices are particularly adapted for the clean-up and subsequent disposal of hazardous, infectious, and toxic wastes.

Typical of many such clean-up devices in the manner of deployment for use, devices according to the Olson '188 and '806 patents are typically dispensed to a user in individual form; commonly a plurality of such clean-up devices are individually folded and provided to the user in a box or stack package. Deployment of these and similar clean-up devices requires the user first open the box or carton, obtain a single device from the box or stack, after indexing and separating the single device from the underlying or adjoining device, and then don the device by inserting his or her hand into the hand recess. As a result of the user touching the adjoining devices or their packaging during such an index and separation procedure, a potential exists for contamination of the entire group of devices. Furthermore, such an index, separation, and donning procedure is often cumbersome, especially when the user is wearing another protective inner glove, as recommended when handling certain wastes. This index, separation and donning procedure is also often time inefficient, a limitation that may be detrimental if the user desires to quickly contain and dispose certain spills.

The above described technique for accessing these prior clean-up and containment devices leaves much to be desired in terms of ease and time rate with which the clean-up device are properly deployed from their packaged state prior to use. Equally important, the prior art packaging approaches for such clean-up devices provide limited protection against cross-contamination. A small amount of waste chemical or material transferred or otherwise discharged upon the box or stack of clean-up devices may easily contaminate an entire group.

The technique of dispensing disposable gloves from a roll or arrayed dispenser is also known, as shown in U.S. Pat. Nos. 4,677,697 and 4,773,532. However, this method has proven suitable only for two-layered articles such as gloves which may be fabricated in sheet form from two parallel plies of material which may be bonded together to form the enclosed articles. In addition, the art in this area teaches orienting the hand-receiving openings along the perforated joining edges, which unduly restricts donning the glove. Such methods are not suitable for the manufacture and use of a multi-layer clean-up device having a combined bag, mitt, and absorbent-material layer.

The present invention provides an apparatus and method for access for a plurality of material-containment devices to be individually provided to and donned by a user in a more efficient manner.

It is a further object of the present invention to provide a spiral roll package of material-containment devices from which individual devices are readily dispensed.

It is another object of the present invention to provide a package of material-containment devices resistant to contamination during storage and handling, and amenable to low cost manufacture.

These objects and other objects and advantages of the invention will be apparent from the following description.

SUMMARY OF THE INVENTION

In fulfillment of the above and other objectives, the present invention relates to material-containment devices, and more particularly to an arranged plurality of hand-held material containment and disposal devices. The device of the present invention includes a flexible bag having an interior surface and an exterior surface. A hand-receiving structure is preferably included within the flexible bag (or may be defined by the bag itself) and is adapted to receive at least a portion of the user's hand to facilitate use of the device. Preferably, the hand-receiving structure is leak-proof and generally conforms to the width of the user's hand. Alternatively, the hand-receiving structure may generally conform to the shape of the user's hand, having an outline which is glove or mitt shaped and may be ambidextrous. An outer absorbent pad or layer is provided over at least part of the exterior surface of the bag for material absorption or capture. Subsequent to the absorption or capture of waste material(s), the flexible bag may be everted to create a receptacle for containing the waste material. The device of the present invention further includes a closure structure for sealing the contents within the receptacle prior to disposal.

The present invention further relates to a plurality of the above described material containment and disposal devices which are arranged and interconnected into an array form. The present invention still further relates to a spiral roll form of an arrayed plurality of material-containment devices which promotes ease of use and efficient access to an individual device.

The packaging approach of the present invention allows the user to quickly and efficiently separate adjoining material-containment devices with minimized potential for cross-contamination.

In illustrated embodiments, the material-containment devices are provided in a spiral roll form, with a user-separable connection structure between adjoining devices. Preferably, the roll of material-containment devices may be maintained within a wall-mounted roll holding apparatus, placed upon a vertical roll holder, or simply reside within a box or carton. The user-separable connection structure between adjoining material-containment devices may, for example, include a perforated structure, or a strip of releasable adhesive material. In illustrated embodiments, the individual material-containment devices are separably connected to adjacent devices by perforated-connection structures which are adequate to hold the devices together, yet not so strong as to damage the devices upon detachment. Preferably, the perforated connection structures are transverse tear lines which are uniformly spaced along the length of the array. In the illustrated embodiment, the hand-receiving structures of adjoining material-containment devices are oriented generally parallel to the tear lines. In another embodiment of the invention, the material-containment devices may be arranged so that the accesses to the hand-receiving structures alternate between a left side and a right side of the roll. Applicant has found that the benefits of providing a plurality of devices in array form and orienting the hand-receiving structure and opening in the described manner include: ease of access to individual devices; improved efficiency of deployment; and low cost manufacture.

A preferred method of deployment for use of an individual material-containment device from the arranged plurality of material-containment devices according to the present invention comprises: obtaining an arranged plurality of material-containment devices in an array form and sequenced in an array extension direction, preferably provided in roll form and including perforated connection structure between individual material-containment devices; biasing a presently sequenced material-containment device away from the remaining roll of devices; inserting a user's hand into a hand-receiving structure of the presently accessed material-containment device, said hand-receiving structure preferably oriented substantially non-parallel to the array extension direction; restraining the roll of remaining devices against movement; and operably manipulating the user's hand and/or forearm to separate the accessed material-containment device from the remaining devices along an associated perforated connection structure.

Preferably, the material-containment device of the present invention is made in laminate manner from arranged plies of a flexible material. The arranged plies are selectively heat-bonded together to form the flexible bag having an exterior surface and an interior surface and to form the hand-receiving structure within the flexible bag. In another embodiment, an absorbent material ply is disposed upon at least a portion of the outer surface and is heat-bonded (or otherwise adhered) in place. The material-containment devices are preferably web-formed from material webs including flexible material webs and an absorbent material web. During web processing the material webs are combined and patterned into individual material-containment devices. The connection structure is similarly patterned upon webs to provide easy disassociation of an individual material-containment devices by the user as described herein.

Other objects and various further features of the invention will be pointed out or will readily be recognized by those skilled in the art from a reading of the following specification in conjunction with the accompanying drawings. The drawings show, for illustrative purposes only, a preferred form of the invention.

BRIEF DESCRIPTION OF THE DRAWING

For a fuller understanding of the nature and objects of the invention, reference should be made to the following detailed description taken in connection with the accompanying drawing in which similar reference numerals indicate corresponding parts in all the figures of the drawing.

DETAILED DESCRIPTION OF THE PREFERRED EMBODIMENTS

Figure 1:
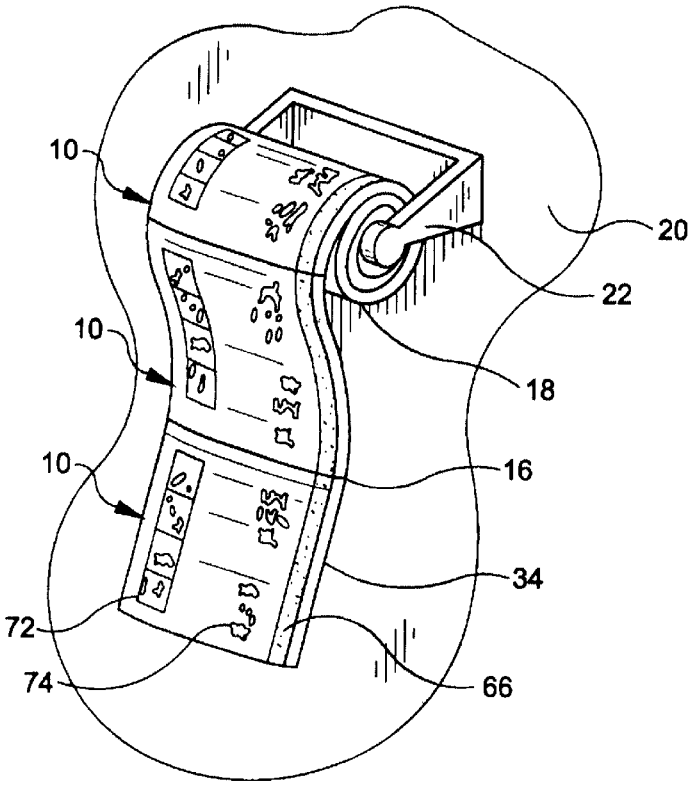
FIG. 1 is a perspective view of an embodiment of the roll package for a plurality of the material-containment devices of the present invention shown mounted in a roll holding structure for facilitating removal of material-containment devices from the roll package.

Referring to FIGS. 1–5, an embodiment of the present invention is shown comprised of an arranged plurality of interconnected individual material-containment devices 10 which are provided to a user in the form of an array 12 of devices 10. With specific reference to FIG. 2, the array 12 is formed from individual material-containment devices 10 which are interconnected to one another and extend in a serial manner in an array extension direction 14. Individual material-containment devices 10 are connected to adjacent material-containment devices 10 by connection structure 16 as described herein. With reference to FIG. 1, a preferred embodiment of the array-arranged plurality of material-containment devices 10 is the form of a spiral roll 18. Alternatively, the array-arranged plurality of material-containment devices 10 may be fan-folded or otherwise folded into a compact form. Spiral roll 18 of material-containment devices 10 may be secured to a wall surface 20 through a horizontal roll mounting structure 22 or simply be placed on a vertical roll holding structure (not shown), both as is conventional in other fields of art, such as paper-towel holders and the like.

Figure 3:
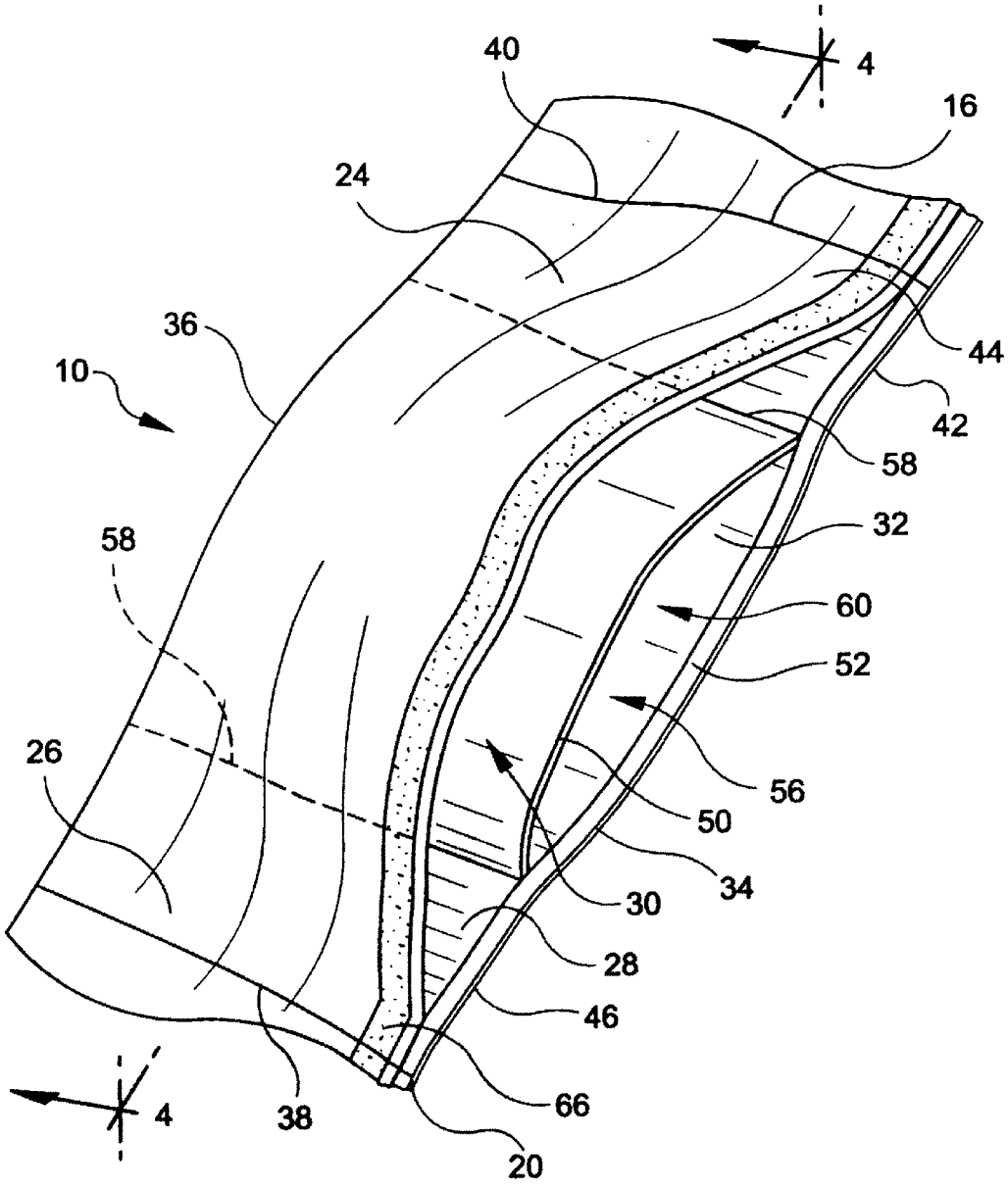
FIG. 3 is a perspective view of an embodiment of the present invention showing interior and exterior surfaces of a material-containment device

The individual material-containment devices 10 of the present invention are shown in FIG. 3 prior to use (non-everted state). The material-containment devices 10 include: a bag 24 having an exterior surface 26, an interior surface 28, and an interior region 30; a hand-receiving structure 32 positioned within the interior region 30 of the bag 24; and an absorbent material structure 34 disposed on a portion of the exterior surface 26 of the bag 24. Material-containment devices 10 are preferably rectangularly shaped and include a front edge 36, side edges 38, 40, and a rear edge 42. Material-containment devices preferably further include a top surface 44 and a bottom surface 46.

Figure 4:
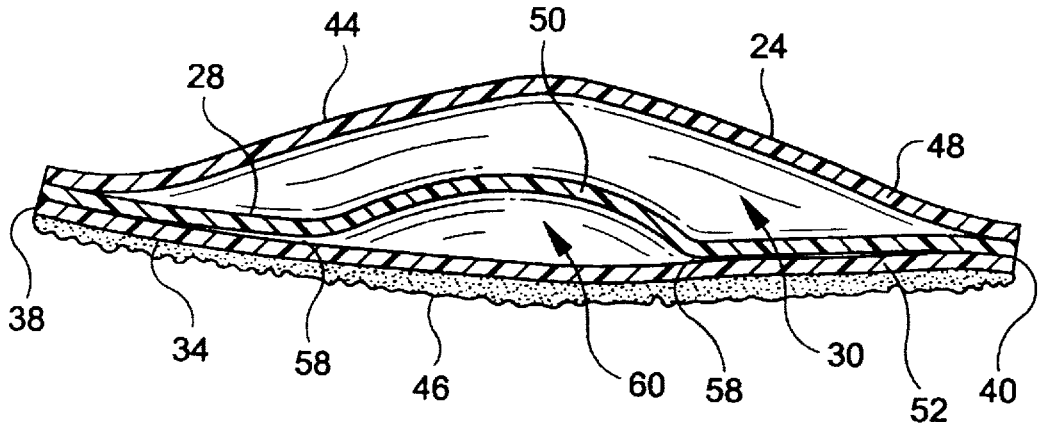
FIG. 4 is a cross sectional view of FIG. 3, taken along line 4—4 in FIG. 3.

As shown in FIGS. 3 and 4, material-containment devices 10 according to the present invention are formed from three ply layers: a top ply 48; a middle ply 50; and a bottom ply 52. The ply layers 48, 50, 52 are made of flexible material to provide relatively easy eversion of the bag 24 as described herein. The plies 48, 50, 52 are preferably heat-bondable plastic selected from among a group of flexible plastics material well known in the art as well as various cut-resistant materials such as Kevlar® from Dupont, etc. During one step of the device manufacture, the plies 48, 50, 52 are co-extensively layered and heat bonded together along the elongated front edge 36 and attachment lines forming the side edges 38, 40 of the bag 24. Other steps of manufacture of the material-containment device 10 will be described hereinafter.

Still with reference to FIGS. 3 and 4, the hand-receiving structure 32 is positioned within the interior region 30 of bag 24 prior to use of the material-containment device 10. Hand-receiving structure 32 serves as an interface between the user's hand 54 and the material-containment device 10 and allows the user to facilely manipulate the device 10. Hand-receiving structure 32 each include an opening 56, a periphery 58, and an interior region 60. Hand-receiving structure 32 is formed by selectively heat-bonding the middle ply 50 and the bottom ply 52 together along the structure periphery 58. The shape of the hand-receiving structure 32 outlined by the structure periphery 58 is simply shaped as an elongated rectangle which is open for access along bag side 42 through structure opening 56. Hand-receiving structure 32 may alternatively generally conform to the shape of the user's hand 54, having an outline which is an ambidextrous glove or mitt shape (not shown) as taught in the Olson '188 or '806 patents. Hand-receiving structure opening 56, through which the user's hand 54 is inserted prior use, is sized to accommodate a variety of user's hand size. Preferably, hand-receiving structure opening 56 is approximately 6 inches wide in a flattened state. The user's hand 54 is received through opening 56 into interior 60 permitting the user to wipe or otherwise manipulate the material-containment device 10 in a conventional manner. Hand-receiving structure 32 is preferably leak-proof along its periphery 58 so that the interior 60 is separate from the bag interior 30. As will be discussed hereinafter with reference to a second embodiment of FIG. 5, the hand-receiving structure 32 can open at either side 76, 78 of the roll 18 of material-containment devices 10.

Figure 5:
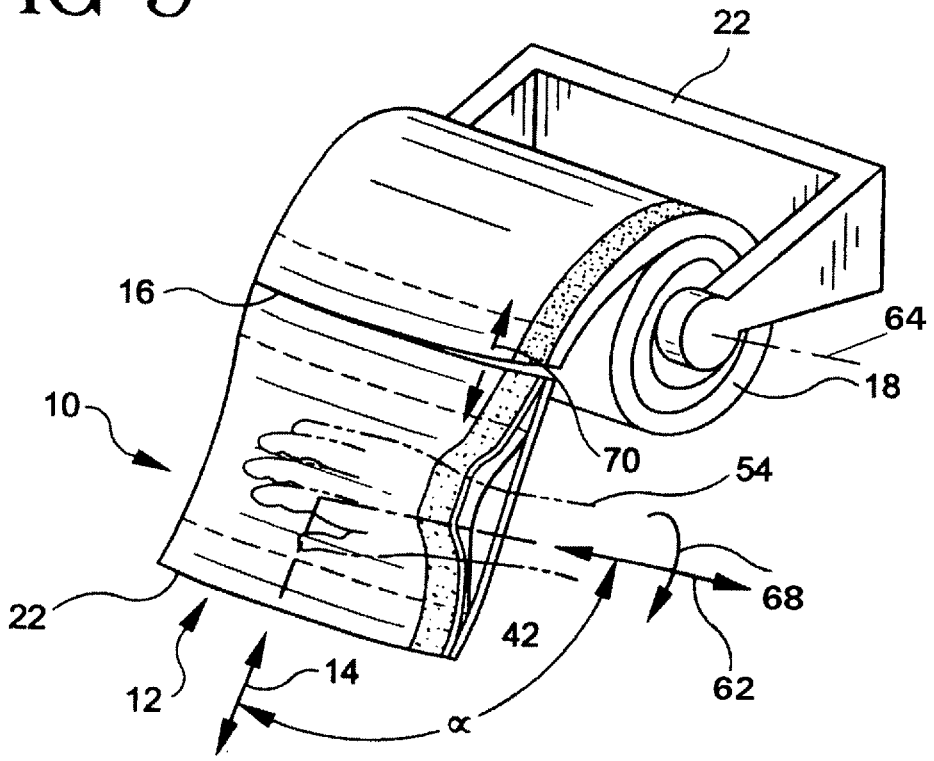
FIG. 5 is a perspective view of an embodiment of the present invention illustrating the preferred method of access of an individual material-containment device from the roll of material-containment devices.

A hand-receiving direction of orientation 62 is also associated with the hand-receiving structure 32. The hand-receiving structure direction of orientation 62 is defined as generally the relative direction along which the user's hand 54 is inserted into and received by the hand-receiving structure 32. In the illustrated embodiment, a user's fingers are generally aligned in the direction of orientation. In this embodiment, the hand-receiving structure direction of orientation 62 is substantially perpendicular to the array extension direction 14, as illustrated in FIG. 5 by an angle $\alpha$, of approximately 90°. In the embodiment shown in FIG. 5, the hand receiving direction of orientation 62 is substantially parallel to a spiral roll axis 64. Preferably, the hand-receiving structure 32 has a direction of orientation 62 which is substantially non-parallel with the array extension direction 14.

In the embodiment of FIGS. 1–5, the absorbent material structure 34 includes an absorbent layer selected from among a group of absorbent materials known in the art. Absorbent layer 34 is preferably selected from a group of generally heat bondable materials allowing absorbent layer 34 to be heat-bonded to the exterior surface 26 of the bag 24. In this embodiment, the absorbent layer 34 covers the entire bottom side 46 of the material-containment device 10. Alternatively, absorbent material structure 34 could be larger or smaller in size relative to the material-containment device 10 and could be adhered or otherwise attached to the bag 24.

Referring still to FIGS. 1–5, individual material-containment devices 10 include a closure structure 66 for closing and sealing the device after eversion. Preferably, the closure structure 66 is an adhesive sealing structure. Adhesive sealing structure 66 in the embodiment shown includes an adhesive strip 66 affixed upon the top side 44 and proximate the rear side 42 of material-containment device 10. Adhesive strip 66 includes a release film or backing (not shown), as is well known in the art. After eversion of the device 10, the adhesive strip 66 is revealed by removing the release film or backing and then sealing the receptacle by folding the adhesive strip 66 over toward and then contacting the interior surface 28 (after eversion, an "exterior" surface) opposite the sealing strip 66. Sealing structure 66 according to the present invention could alternatively include drawstrings, a twist-tie, wire closure, tuck-and-fold flaps, Velco®, or similar cinching or closing structures.

Figure 2:
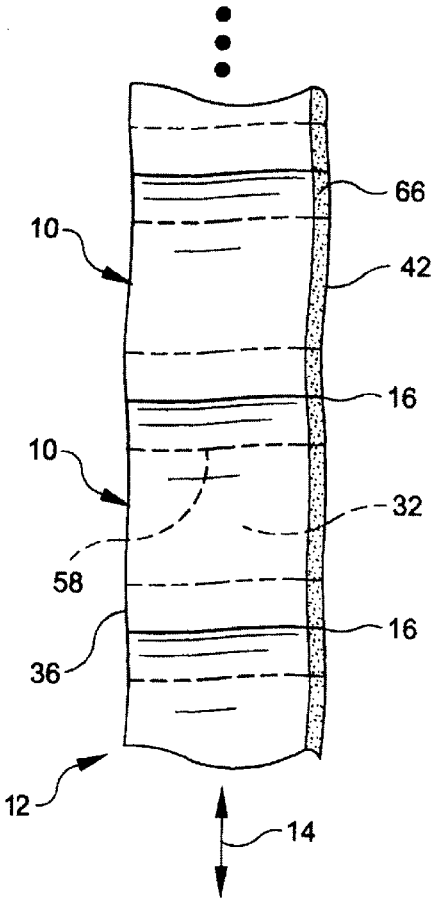
FIG. 2 is a top plan view of an embodiment of the present invention illustrating a plurality of material-containment devices which are interconnected as an array of devices aligned in an array extension direction.

With particular reference to FIGS. 1 and 2, material-containment devices 10 according to the present invention are illustrated as arranged in the preferred array 12 form. Individual material-containment devices 10 are linearly aligned relative to adjacent material-containment devices 10 in the array extension direction 14 and are connected to adjacent devices 10 by a connection structure 16. In one embodiment, individual material-containment devices 10 are also separable from adjacent material-containment devices 10 by the connection structure 16. Connection structure 16 may include many know approaches to selectively and detachably secure items together. Connection structure 16 need only be adequate to hold adjoining material-containment devices 10 together when tension is applied to the array 12 sufficient to deploy or unroll one or more of the devices 10, yet not so strong as to damage an adjoining device 10 or a connection structure 16 upon detachment of one device 10. Connection structure 16 may include, for example, a releasable or tacky adhesive structure, a perforated tear line, or even a film or backing sheet onto which the material-containment devices 10 are temporarily affixed or adhered using a releasable adhesive or static attraction. In an illustrated embodiment, each connection structure 16 is a transverse, perforated tear line. Preferably, connection structures 16 are parallel and uniformly spaced along the array 12 direction of extension 14.

One method of access for use of a material-containment device 10 will be described with reference to FIG. 5. Preferably, an array-arranged plurality of material-containment devices 10 is provided in a spiral roll 18, and is maintained within a roll holder 22 as known in the art. As described herein, the perforated connection structures are each in the form of a parallel, transverse perforated tear line 16. To access an individual material-containment device 10 for use, the user biases the presently sequenced material-containment device 10 (simply, at the "loose" end of the roll 18) away from the remaining plurality of material-containment devices 10, inserts his or her left or right hand 54 through the hand receiving opening 56 and into the hand-receiving structure 32, and manipulates his or her hand 54 and/or forearm generally away from the associated tear line 16 (as indicated by numeral 68) to cause the currently accessed material-containment device 10 to be separated along tear line 16 as indicated by numeral 70. The procedure is repeated if needed to provide material-containment devices 10 on each hand 54. After waste clean-up or other use, the material-containment device 10 may be everted (turned inside-out) in a conventional manner to form a receptacle and sealed with the closure structure 66 prior to disposal.

With reference again to FIG. 1, devices 10 of the embodiment shown include indicia 72, 74 on the exterior surface 26 and the interior surface 28 of the bag 24. Prior to use, "pre-use" indicia 72 is affixed at the exterior surface 26 of the device 10 to be visible to the user and may include trademarks, instructions for proper use, and warnings or precautionary remarks. Once the device 10 is everted, "post-use" indicia 74, initially affixed at an interior surface 26 of the bag 24 opposite the hand-receiving structure 32, is presented to the user or others upon an "exterior" surface of the device 10. Post-use indicia 74 may include, for example, warnings or other precautionary remarks related to handling and subsequent disposal of the device 10.

Figure 6:
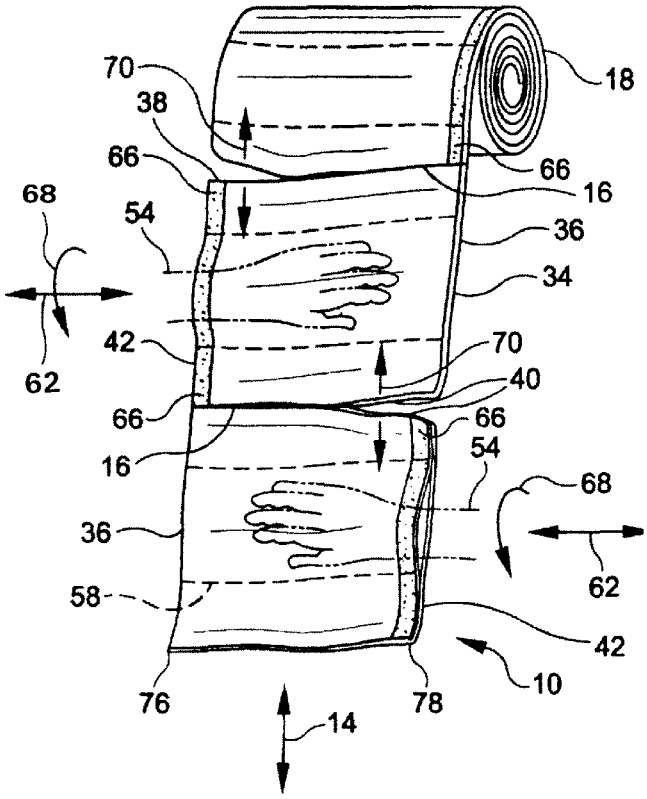
FIG. 6 is a perspective view of a second embodiment of the present invention illustrating an arranged plurality of material-containment devices in spiral roll form in which the hand receiving openings are alternately spaced on right and left sides of material-containment devices.

With reference to FIG. 6, a further embodiment of the present invention is illustrated. The arranged plurality of material-containment devices 10 is similarly provided in roll form 18. However, the hand receiving openings 56 of the second embodiment are alternatively positioned on opposite left 76 and right 78 sides of roll. In this embodiment, the user may quickly and simultaneously access material-containment devices 10 for both left and right hands 54. Separation of individual material-containment devices 10 is similarly made when the user manipulates the material-containment device 10 away from its associated connection structure 16.

Material-containment devices 10 according to the present invention are preferable manufactured with automated web processing machinery, as known in the art. In the above described preferred embodiment the three flexible material ply layers 48, 50, 52, the absorbent material layer 34, and the adhesive strip 66 are introduced into the web processor (not shown) from material rolls (not shown). The ply layer webs are applied over each other and bonded into segments at attachment lines which define the individual containment devices. While being processed, the webs are selectively heat bonded in pattern to form the bag structure 24 and the interior hand-receiving structure 32 and to affix the absorbent layer structure 34 in the prescribed location. Likewise, the attachment lines may be comprised of a perforated separation structure 16 that is patterned upon the layers between the individual devices 10. Utilizing known web processing techniques, individual material-containment devices 10 are efficiently formed in the array 12 configuration.

Figure 7:
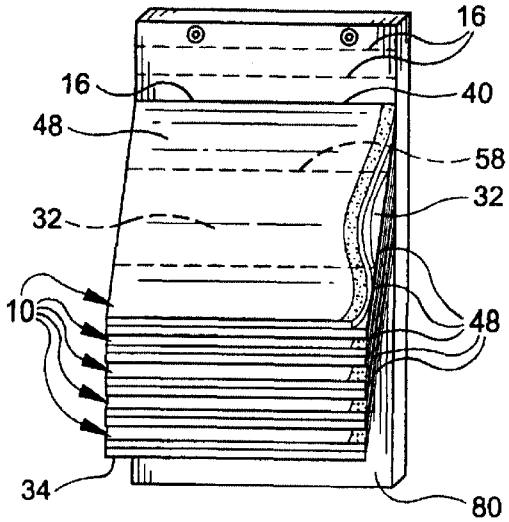
FIG. 7 is a perspective view of a third embodiment of the plurality of material-containment devices shown mounted in an overlapping manner upon a backing member.

Referring now to FIG. 7, another embodiment of the present invention is illustrated. In this embodiment, individual material-containment devices 10 are arranged in an overlapping manner and are selectively and detachably secured along a side edge 40 to a backing member 80, which may be secured to a wall. The plurality of material-containment devices 10 is in a stack form. Connection structure 16 is formed as a perforation between the bag 24 and the backing member 80. Individual material-containment devices 10 are removed from the plurality of devices 10 as the user manipulates his or her hand within the associated hand-receiving structure 32 in a direction away from the associated separation structure 16 and backing member 80.

While preferred embodiments of the above described arrangement of material-containment devices have been described in detail with reference to the attached drawings, it is understood that various changes, modifications, and adaptations may be made in the arrangement or its method of operation or range of applications without departing from the spirit and scope of the appended claims.

What is claimed is:

1. A roll of containment devices, comprising:

a web of material having a top ply of material, a middle ply of material, and a bottom ply of material, each ply of material having a top side, a bottom side, a front edge, a back edge, and a direction of elongation, said middle ply attached at predetermined locations on said bottom ply to form a plurality of hand receiving structures, said top ply attached to said middle ply at predetermined locations to form a plurality of bag structures having one of said plurality of hand receiving structures within each said bag structure, said top, middle, and bottom plies further being attached at predetermined locations to form containment devices each having one said hand receiving structure and one said bag structure, each said containment device having the top, middle, and bottom plies attached along one said edge.

2. The roll of containment devices of claim 1, wherein said hand receiving structure is arranged perpendicular to one of said edges.

3. The roll of containment devices of claim 1, wherein each said bag structure is constructed of a generally fluid impervious material.

4. The roll of containment devices of claim 1, wherein each said hand receiving structure is constructed of a generally fluid impervious material.

5. The roll of containment devices of claim 1, wherein the attachments forming the containment devices and the bag structures are at the same locations.

6. The roll of containment devices of claim 1, wherein each said containment device is further comprised of a ply of absorbent material attached to the bottom side of said bottom ply.

7. The roll of containment devices of claim 1, wherein the locations attached to form the containment devices detachably secure the devices in a serial manner.

8. The roll of containment devices of claim 7, wherein the locations attached to form the containment devices are aligned perforations.

9. The roll of containment devices of claim 1, wherein the plies are attached by heat bonding.

10. A plurality of serially attached containment devices each having at least three plies, comprising:

a) an elongated web of bottom material having a top side, a bottom side, and two generally parallel elongated edges, said bottom material being divided into segments by a plurality of attachment lines drawn between and oriented generally perpendicular to said edges, each said segment defining the bottom ply for one containment device;

b) an elongated web of middle material applied over said top side of said bottom material and being attached to said web of bottom material along said plurality of attachment lines forming two ply segments and each said segment having said middle and bottom webs attached along one of said edges, said middle material constructed and arranged to form a hand receiving structure within each segment defined by said plurality of attachment lines; and c) an elongated web of top material applied over said middle material and being attached to said web of middle material along said plurality of attachment lines forming three ply segments and each said segment having said top and middle webs attached along the same edge as said middle and bottom webs of material are attached, said top material constructed and arranged to form a bag structure within each segment defined by said plurality of attachment lines and having one of said hand receiving structures encompassed within each said bag structure.

11. The plurality of serially attached devices of claim 10, wherein said devices are connected in a stack form for use.

12. The plurality of serially attached containment devices of claim 10, wherein said plies are attached by an adhesive material.

13. The plurality of serially attached containment devices of claim 10, wherein each said bag structure is evertable around the containment device.

14. The plurality of serially attached containment devices of claim 10, wherein the edge in which said plies are attached is alternated for each successive device.

15. A plurality of serially attached containment devices, comprising:

a) an elongated web of bottom ply material having a length, a top side, a bottom side, two generally parallel elongated edges, and a generally uniform width between said edges;

b) an elongated web of middle ply material having a top side, a bottom side, two edges, and substantially the same width and length as said web of bottom material, said middle material applied substantially co-extensively over said top side of said bottom ply material and attached to said bottom material along a plurality of attachment lines extending between and oriented generally perpendicular to said edges, whereby said attachment forms a two ply web and whereby said attachment lines partition said length of said co-extensive two ply web into segments, each said segment having said bottom and middle materials attached along one of said edges, said middle material further constructed and arranged to form a hand receiving structure within each said segment formed between the bottom side of said middle material and the top side of said bottom material; and c) an elongated web of top ply material having a bottom side, two edges, and substantially the same width and length as said web of bottom material, applied substantially co-extensively over said middle material and being attached to said middle material along said plurality of attachment lines, forming a three ply web of segments, each said segment having said middle and bottom plies attached along one edge, said top material further constructed and arranged to form a bag structure within each said segment and having one of said hand receiving structures defined within said bag structure.

16. The plurality of serially attached containment devices of claim 15, wherein said three ply web is provided in a spiral roll for use.

17. The plurality of serially attached containment devices of claim 15, wherein said three ply web is accordion folded for use.

18. The plurality of serially attached containment devices of claim 15, wherein each of the containment devices has a sealing structure for closing and sealing the device.

19. The plurality of serially attached containment devices of claim 15, wherein the sealing structure is an adhesive strip with a release liner for protecting the adhesive strip until use.

20. A method of providing a plurality of material-containment devices, each said material-containment device including a bag of flexible material and a hand-receiving structure for disposing said device on at least a portion of a hand of a user, said hand-receiving structure having a direction of orientation relative to said device, said method comprising the steps of:

a) providing a multi-ply web of material having an extension direction;

b) sectioning and defining said multi-ply web into a plurality of serially disposed material-containment device, each material-containment device having a hand-receiving structure and an evertable bag for eversion around said hand-receiving structure, said hand-receiving structure being attached within said evertable bag; and c) rolling the plurality of material-containment devices into a spiral roll.

* * * * *